US008447213B2

(12) United States Patent
Kim et al.

(10) Patent No.: US 8,447,213 B2
(45) Date of Patent: May 21, 2013

(54) IMAGE FORMING APPARATUS AND PRINTING METHOD USABLE WITH THE SAME

(75) Inventors: Gun-ho Kim, Seoul (KR); Yun-su Kim, Yongin-si (KR)

(73) Assignee: SAMSUNG Electronics Co., Ltd., Suwon-si (KR)

( * ) Notice: Subject to any disclaimer, the term of this patent is extended or adjusted under 35 U.S.C. 154(b) by 294 days.

(21) Appl. No.: 12/888,665

(22) Filed: Sep. 23, 2010

(65) Prior Publication Data

US 2011/0097112 A1 Apr. 28, 2011

(30) Foreign Application Priority Data

Oct. 28, 2009 (KR) ..... 10-2009-102823

(51) Int. Cl.
*G03G 15/00* (2006.01)
*G03G 15/16* (2006.01)

(52) U.S. Cl.
USPC ..... 399/167; 399/66

(58) Field of Classification Search
USPC ..... 399/38, 66, 127, 128, 167, 299, 300, 399/302
See application file for complete search history.

(56) References Cited

U.S. PATENT DOCUMENTS 6,173,141 B1 * 1/2001 Sakagami et al. ..... 399/167
8,041,244 B2 * 10/2011 Kojima ..... 399/66
8,165,483 B2 * 4/2012 Shiori ..... 399/38

* cited by examiner

*Primary Examiner* — Sandra Brase
(74) *Attorney, Agent, or Firm* — Stanzione & Kim, LLP

(57) ABSTRACT

A printing method usable with an image forming apparatus includes initiating driving of a plurality of photosensitive bodies and a transfer belt, printing an image by transferring toner images formed on the plurality of photosensitive bodies to the transfer belt and finally transferring the toner images, which are transferred to the transfer belt, to paper, and stopping the driving of the plurality of photosensitive bodies and the transfer belt after the printing is completed. The initiating of the driving of the plurality of photosensitive bodies and the transfer belt includes applying drive initiating signals with a time interval to a first driving unit and a second driving unit to respectively drive the plurality of photosensitive bodies and the transfer belt to enable the plurality of photosensitive bodies and the transfer belt to simultaneously begin rotating/moving.

21 Claims, 6 Drawing Sheets

IMAGE FORMING APPARATUS AND PRINTING METHOD USABLE WITH THE SAME

CROSS-REFERENCE TO RELATED APPLICATIONS

This application claims the benefit of priority under 35 U.S.C. §119(a) from Korean Patent Application No. 10-2009-0102823, filed on Oct. 28, 2009, in the Korean Intellectual Property Office, the disclosure of which is incorporated herein in its entirety by reference.

BACKGROUND

1. Field of the Invention

The present general inventive concept relates to an image forming apparatus including at least one photosensitive body and a transfer belt to which a toner image is transferred from the at least photosensitive body, and a printing method used by the image forming apparatus.

2. Description of the Related Art

Electrophotographic image forming apparatuses print an image by forming an electrostatic latent image corresponding to image information on a surface of a photosensitive drum, developing the electrostatic latent image by using toner to obtain a toner image, and transferring and fixing the toner image onto a recording medium.

Electrophotographic color image forming apparatuses print an image by respectively forming cyan (C), magenta (M), yellow (Y), and black (B) toner images on four photosensitive drums, transferring the toner images to a transfer belt to form an overlapped color toner image, and finally transferring and fixing the overlapped color toner image to a recording medium.

SUMMARY OF THE INVENTION

The present general inventive concept provides an electrophotographic image forming apparatus and a printing method usable with the same which can prevent damage to a photosensitive drum and prevent a band image due to an intermediate transfer bias and/or a speed difference between a transfer belt and the photosensitive drum.

Additional features and utilities of the present general inventive concept will be set forth in part in the description which follows and, in part, will be obvious from the description, or may be learned by practice of the general inventive concept.

The foregoing and/or other features and utilities of the general inventive concept may be achieved by a printing method usable with an image forming apparatus, the method including initiating driving of a plurality of photosensitive bodies and a transfer belt, printing an image by forming toner images on the plurality of photosensitive bodies, which are charged by a plurality of charging units, applying an intermediate transfer bias to a plurality of intermediate transfer units, which face the plurality of photosensitive bodies with the transfer belt therebetween, to transfer the toner images to the transfer belt, and finally transferring the toner images, which are transferred to the transfer belt, to paper, and stopping the driving of the plurality of photosensitive bodies and the transfer belt after the printing of the image is completed, wherein the initiating of the driving of the plurality of photosensitive bodies and the transfer belt comprises applying drive initiating signals with a time interval to a first driving unit to drive the plurality of photosensitive bodies and a second driving unit to drive the transfer belt to enable the plurality of photosensitive bodies and the transfer belt to begin simultaneously rotating/moving.

A second drive initiating signal may be first applied to the second driving unit, and then after the time interval elapses, a first drive initiating signal may be applied to the first driving unit.

The plurality of photosensitive bodies and the transfer belt may reach a speed corresponding to a predetermined process speed through a plurality of acceleration stages.

The initiating of the driving of the plurality of photosensitive bodies and the transfer belt may include, before applying the drive initiating signals, moving the transfer belt to a position where the transfer belt contacts the plurality of photosensitive bodies and to another position where the transfer belt is spaced apart from at least one of the plurality of photosensitive bodies.

The initiating of the driving of the plurality of photosensitive bodies and the transfer belt may include, before initiating printing, previously rotating/moving the plurality of photosensitive bodies and the transfer belt during a previous rotation time in a state where a charge bias is applied to the plurality of charging units to charge the plurality of photosensitive bodies, wherein, when the printing is divided into intermittent printing and continuous printing based on a waiting time after previous printing, and the previous rotation time during the intermittent printing is referred to as a first previous rotation time and the previous rotation time during the continuous printing is referred to as a second previous rotation time, the previously rotating/moving of the plurality of photosensitive bodies and the transfer belt comprises making the second previous rotation time longer than the first previous rotation time.

If the waiting time is less than 20 minutes, the printing may be determined to be the continuous printing, and if the waiting time is greater than 20 minutes, the printing may be determined to be the intermittent printing.

When a distance between an uppermost photosensitive body of the plurality of photosensitive bodies and a lowermost sensitive body of the plurality of photosensitive bodies in a moving direction of the transfer belt is L1, and a circumferential distance between a contact point between the lowermost photosensitive body and the transfer belt and a charging unit corresponding to the lowermost photosensitive body is L2, the second previous rotation time may be greater than a time taken for the lowermost photosensitive body to be rotated by a distance corresponding to L1+L2.

The previously rotating/moving of the plurality of photosensitive bodies and the transfer belt may include adding a first additional previous rotation time to the previous rotation time when an image having high coverage and high density needs to be printed.

When an image having a coverage of greater than 30% and a density of greater than 30% needs to be printed, the first additional previous rotation time may be used.

The previously rotating/moving of the plurality of photosensitive bodies and the transfer belt may include using a second additional previous rotation time when a process speed is less than a reference process speed.

When a distance between a lowermost photosensitive body of the plurality of photosensitive bodies and an uppermost photosensitive body of the plurality of photosensitive bodies in a moving direction of the transfer belt is L1 and a circumferential distance between a contact point between the lowermost photosensitive body and the transfer belt and a charging unit corresponding to the lowermost photosensitive body is L2, the stopping of the driving of the plurality of photosensitive bodies and the transfer belt may include: stopping the plurality of photosensitive bodies and the transfer belt after the lowermost photosensitive body is rotated by at least a distance corresponding to L1+L2 after the intermediate transfer bias is turned off, and turning off a charge bias applied to the plurality of charging units after the plurality of photosensitive bodies are stopped.

The foregoing and/or other features and utilities of the general inventive concept may also be achieved by an image forming apparatus including a plurality of photosensitive bodies, a plurality of charging units to which a charge bias to charge the plurality of photosensitive bodies to a uniform potential is applied, an exposure unit which forms electrostatic latent images to correspond to image information on the plurality of photosensitive bodies that are charged to the uniform potential, a plurality of developing units which supply toner to the electrostatic latent images to form visible toner images, a transfer belt which faces the plurality of photosensitive bodies and allows the toner images to be transferred to the transfer belt, a plurality of intermediate transfer units to which an intermediate transfer bias to transfer the toner images to the transfer belt is applied, a first driving unit and a second driving unit which drive the plurality of photosensitive bodies and the transfer belt, respectively, and a control unit which applies drive initiating signals with a time interval to the first driving unit and the second driving unit so that the plurality of photosensitive bodies and the transfer belt begin simultaneously rotating/moving.

The control unit may first apply a second drive initiating signal to the second driving unit, and then, after the time interval is elapsed, apply a first drive initiating signal to the first driving unit.

The control unit may control the first driving unit and the second driving unit so that the plurality of photosensitive bodies and the transfer belt reach a speed corresponding to a predetermined process speed through a plurality of acceleration stages.

The image forming apparatus may further include a belt moving unit which moves the transfer belt to a contact position where the transfer belt contacts the plurality of photosensitive bodies and to a separation position where the transfer belt is spaced apart from at least one of the plurality of photosensitive bodies, wherein the control unit controls the first driving unit, the second driving unit, and the belt moving unit to move the transfer belt to the contact position and to the separation position in a state where the plurality of photosensitive bodies and the transfer belt are stopped.

When a distance between an uppermost photosensitive body of the plurality of photosensitive bodies and a lowermost photosensitive body of the plurality of photosensitive bodies in a moving direction of the transfer belt is L1 and a circumferential distance between a contact point between the lowermost photosensitive body and the transfer belt and a charging unit corresponding to the lowermost photosensitive body is L2, the control unit may control the first driving unit and the second driving unit to stop the plurality of photosensitive bodies and the transfer belt after the lowermost photosensitive body is rotated by a distance corresponding to L1+L2 after the intermediate transfer bias is turned off, and turns off the charge bias applied to the plurality of charging units after the plurality of photosensitive bodies are stopped.

The foregoing and/or other features and utilities of the general inventive concept may also be achieved by a printing method of preventing a band image on a paper due to an intermediate transfer bias applied in an image forming apparatus, the method comprising: printing an image in a first printing operation by forming toner images on a plurality of photosensitive bodies, applying an intermediate transfer bias to a plurality of intermediate transfer units that face the plurality of photosensitive bodies to transfer the toner images to a transfer belt, and transferring the toner images from the transfer belt to the paper; stopping the plurality of photosensitive bodies and the transfer belt from moving after the image is printed; and printing an image in a second printing operation by rotating the photosensitive bodies according to a predetermined rotation and then forming toner images on the plurality of photosensitive bodies, applying an intermediate transfer bias to the plurality of intermediate transfer units to transfer the toner images to the transfer belt, and transferring the toner images from the transfer belt to the paper.

The first printing operation may include pre-printing, printing, and post-printing.

The pre-printing may be divided into a continuous printing and an intermittent printing which are determined based a waiting time in which a printing operation is performed.

The pre-printing is determined to be the continuous printing if the waiting time is less than 20 minutes, or the intermittent printing if the waiting time is greater than 20 minutes.

The printing method may further include setting a first rotation time to rotate the photosensitive bodies during the intermittent printing and setting a second rotation time to rotate the photosensitive bodies during the continuous printing.

When a distance between an uppermost photosensitive body of the plurality of photosensitive bodies and a lowermost sensitive body of the plurality of photosensitive bodies in a moving direction of the transfer belt is L1, and a circumferential distance between a contact point between the lowermost photosensitive body and the transfer belt and a charging unit corresponding to the lowermost photosensitive body is L2, the second rotation time used to rotate the photosensitive bodies may be greater than a time taken for the lowermost photosensitive body to be rotated by a distance corresponding to L1+L2.

The foregoing and/or other features and utilities of the general inventive concept may also be achieved by a printing method of preventing a band image on a paper due to an intermediate transfer bias applied in an image forming apparatus wherein a printing operation includes forming toner images on a plurality of photosensitive bodies, applying an intermediate transfer bias to a plurality of intermediate transfer units to transfer the toner images to a transfer belt, and transferring the toner images from the transfer belt to the paper, the method comprising: rotating the photosensitive bodies and the transfer belt a predetermined distance after the intermediate transfer bias is turned off from a previous printing operation; stopping the photosensitive bodies and the transfer belt from moving after the photosensitive bodies rotate the predetermined distance; and printing a subsequent image.

The predetermined distance to rotate the photosensitive bodies may correspond to a distance of L1+L2, where L1 is a distance between an uppermost photosensitive body of the plurality of photosensitive bodies and a lowermost sensitive body of the plurality of photosensitive bodies in a moving direction of the transfer belt, and L2 is a circumferential distance between a contact point between the lowermost photosensitive body and the transfer belt and a charging unit corresponding to the lowermost photosensitive body.

The predetermined time may be at least greater than a time taken to rotate the photosensitive bodies the predetermined distance.

The foregoing and/or other features and utilities of the general inventive concept may also be achieved by a printing method usable with an image forming apparatus, the method comprising: applying a first driving power to a plurality of photosensitive bodies and a second driving power to a transfer belt; and printing an image by forming toner images on the plurality of photosensitive bodies, which are charged by a plurality of charging units, applying an intermediate transfer bias to a plurality of intermediate transfer units, which face the plurality of photosensitive bodies with the transfer belt therebetween, to transfer the toner images to the transfer belt, and finally transferring the toner images, which are transferred to the transfer belt, to paper; wherein the first driving power and the second driving power are determined based on characteristics of the plurality of photosensitive bodies and the transfer belt.

In an embodiment, the determination of the characteristics of the plurality of photosensitive bodies and the transfer belt include materials thereof such that the plurality of photosensitive bodies and the transfer belt being rotation at a same time.

BRIEF DESCRIPTION OF THE DRAWINGS

The above and/or other aspects of the present general inventive concept will become apparent and more readily appreciated from the following description of the exemplary embodiments, taken in conjunction with the accompanying drawings, in which.

DETAILED DESCRIPTION OF THE EMBODIMENTS

Figure 1:
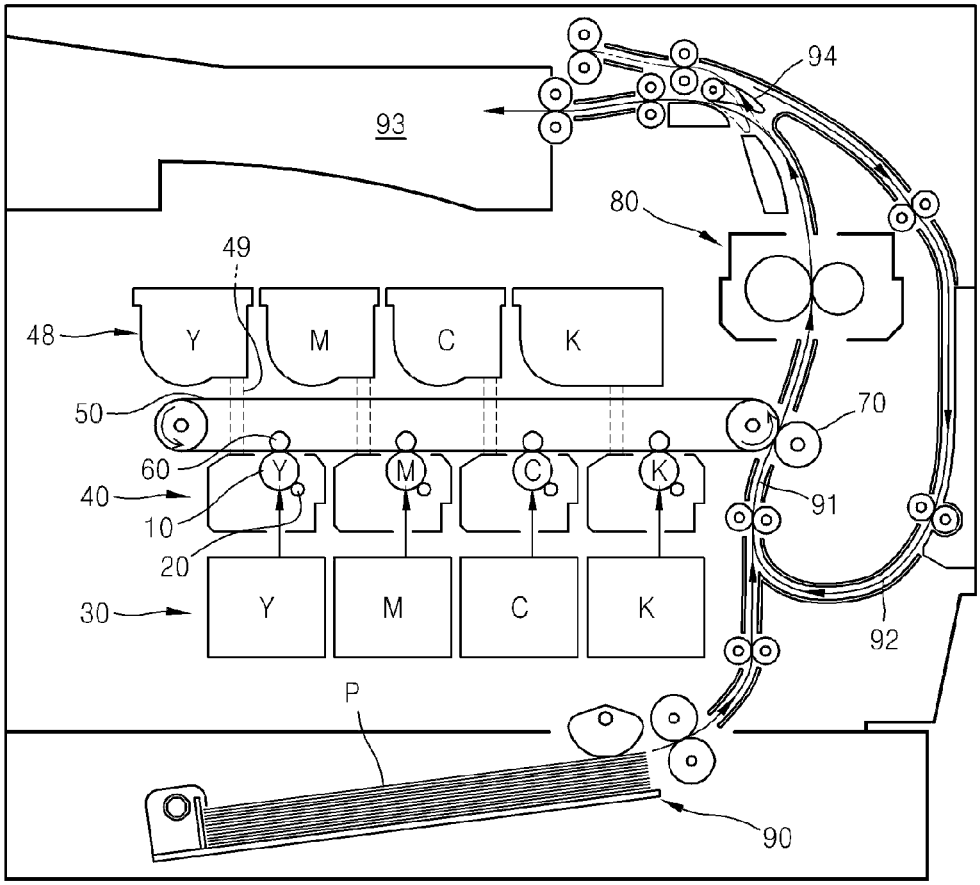
FIG. 1 is a cross-sectional view of an image forming apparatus according to an embodiment of the present general inventive concept.

Reference will now be made in detail to the embodiments of the present general inventive concept, examples of which are illustrated in the accompanying drawings, wherein like reference numerals refer to the like elements throughout. The embodiments are described below in order to explain the present general inventive concept by referring to the figures.

FIG. 1 is a cross-sectional view of an image forming apparatus according to an embodiment of the present general inventive concept. Referring to FIG. 1, the image forming apparatus includes a photosensitive drum 10, a charging roller 20, an exposure unit 30, a developing unit 40, a transfer belt 50, an intermediate transfer roller 60, a final transfer roller 70, and a fixing unit 80. A toner bottle 48 contains toner to be supplied to the developing unit 40, and is connected to the developing unit 40 via a toner supply path 49. The developing unit 40 and the toner bottle 48 may be independently exchanged.

The image forming apparatus of FIG. 1 is an electrophotographic color image forming apparatus to print a color image by using electrophotography. The image forming apparatus prints a color image by using cyan (C), magenta (M), yellow (Y), and black (K) toners. Unless defined otherwise, reference numerals with letters C, M, Y, and K denote elements to form C, M, Y, and K toner images. However, the present embodiment is not limited thereto, and various other toners, e.g., light magenta toner and white toner, may be used.

Figure 2:
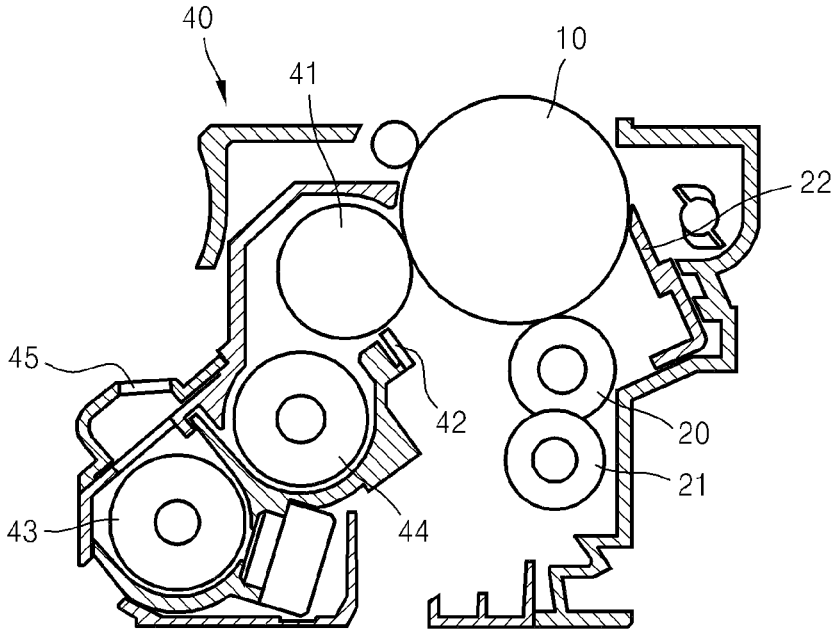
FIG. 2 is a cross-sectional view of a developing unit of the image forming apparatus of FIG. 1.

Referring to FIG. 1, the image forming apparatus employs four developing units 40Y, 40M, 40C, and 40K and 4 charging rollers 20Y, 20M, 20C, and 20K to correspond to four photosensitive drums 10Y, 10M, 10C, and 10K. FIG. 2 is a cross-sectional view illustrating the photosensitive drum 10, the charging roller 20, and the developing unit 40 of the image forming apparatus of FIG. 1. Referring to FIG. 2, the photosensitive drum 10 is a photosensitive body on which an electrostatic latent image is formed. The photosensitive drum 10 may be formed by forming a photosensitive layer on an outer circumferential surface of a metal pipe. The present embodiment is not limited to any specific order in which the photosensitive drums 10Y, 10M, 10C, and 10K and the developing units 40Y, 40M, 40C, and 40K of FIG. 1 are arranged.

The charging roller 20, which is a charging unit to charge a surface of the photosensitive drum 10 to a uniform potential, is formed by forming an elastic rubber layer, such as a urethane layer, on a surface of a conductive shaft. The charging roller 20 is rotated while in contact with the photosensitive drum 10. Instead of the charging roller 20, a charging brush, a corona charging unit, or the like may be used. A charge bias is applied to the charging roller 20. A cleaner 21 removes foreign substances, such as toner or dust, which may become attached to the charging roller 20 from a surface of the photosensitive drum 10. A blade 22 removes any toner remaining on the surface of the photosensitive drum 10 after an intermediate transfer process which will be explained later. Instead of the blade 22, other cleaning devices, such as a rotating brush, may be used.

A developing roller 41 is used to supply toner contained in the developing unit 40 to the photosensitive drum 10. A regulating member 42 regulates an amount of toner supplied by the developing roller 41 to a developing area where the photosensitive drum 10 and the developing roller 41 face each other.

If a two-component developing method is used, magnetic carriers are contained in the developing unit 40, and the developing roller 41 is spaced apart from the photosensitive drum 10. Although not shown, the developing roller 41 may be a magnetic roller or a developing sleeve inside which a magnet roller is disposed. Toner supplied to the developing unit 40 from the toner bottle 48 is attached to surfaces of the magnetic carriers. The magnetic carriers to which the toner is attached are delivered to the developing area, in which the photosensitive drum 10 and the developing roller 41 face each other, by being attached to a surface of the developing roller 41. Only the toner is supplied to the photosensitive drum 10 due to a developing bias applied between the developing roller 41 and the photosensitive drum 10. Therefore, the electrostatic latent image formed on the surface of the photosensitive drum 10 is developed as a visible toner image.

If a one-component developing method without using carriers is used, the developing roller 41 may be rotated while in contact with the photosensitive drum 10, or may be rotated at a distance of tens to hundreds of microns from the photosensitive drum 10.

If the two-component developing method is used, first and second supply members 43 and 44 mix and agitate toner introduced from the toner bottle 48 through a toner inlet 45 with the carriers contained in the developing unit 40, and carry the mixed and agitated toner to the developing roller 41.

If the one-component developing method is used, the first and second supply members 43 and 44 agitate toner introduced from the toner bottle 48 through the toner inlet 45, and carry the agitated toner to the developing roller 41.

Although the developing methods of the image forming apparatus have been explained, the present embodiment is not limited thereto and various modifications may be made to the developing methods.

Referring to FIG. 1 again, the exposure unit 30 is an element that forms an electrostatic latent image by emitting light, which has been modulated to correspond to image information, to the surface of the photosensitive drum 10. Examples of the exposure unit 30 may include a laser scanning unit (LSU) using a laser diode as a light source, and an exposure unit using a light emitting diode (LED) as a light source. Although four exposure units 30C, 30M, 30Y, and 30K to respectively expose the photosensitive drums 10C, 10M, 10Y, and 10K are illustrated in FIG. 1, the present embodiment is not limited thereto. Although not shown, two exposure units to emit two light beams modulated to correspond to image information having two colors may be used, or one exposure unit to emit four light beams modulated to correspond to image information having four colors may be used.

The transfer belt 50 is in contact with the photosensitive drum 10. The intermediate transfer roller 60 is a transfer unit to transfer a toner image developed on the photosensitive drum 10 to the transfer belt 50. Instead of the intermediate transfer roller 60, a corona transfer unit or a pin scorotron transfer unit may be used. The intermediate transfer roller 60 faces the photosensitive drum 10 with the transfer belt 50 therebetween. An intermediate transfer bias is applied to the intermediate transfer roller 60. As shown in FIG. 1, the image forming apparatus of FIG. 1 employs four intermediate transfer rollers 60C, 60M, 60Y, and 60K facing the photosensitive drums 10C, 10M, 10Y, and 10K.

The final transfer roller 70 is a final transfer unit to transfer the toner image, which is transferred to the transfer belt 50, to paper P. The final transfer roller 70 faces the transfer belt 50. A final transfer bias to transfer the toner image on the transfer belt 50 to the paper P is applied to the final transfer roller 70. Instead of the final transfer roller 70, a corona transfer unit may be used.

The fixing unit 80 applies heat and/or pressure to the image transferred to the paper P to fix the image onto the paper P. The present embodiment is not limited to the structure of the fixing unit 80 of FIG. 1.

A printing method used by the image forming apparatus constructed as described above will now be explained. When a charge bias is applied to the charging roller 20, the photosensitive drum 10 is charged to a uniform potential. The exposure units 30Y, 30M, 30C, and 30K respectively scan four light beams, which have been modulated to correspond to image information having four colors, to the photosensitive drums 10Y, 10M, 10C, and 10K to form electrostatic latent images. The electrostatic latent images of the photosensitive drums 10Y, 10M, 10C, and 10K are developed as visible toner images due to C, M, Y, and K toners supplied to the developing units 40Y, 40M, 40C, and 40K from toner bottles 48Y, 48M, 48C, and 48K. When an intermediate transfer bias is applied to the intermediate transfer rollers 60Y, 60M, 60C, and 60K, the toner images on the photosensitive drums 10Y, 10M, 10C, and 10K are sequentially transferred to the transfer belt 50 to form a color toner image. Paper P stacked in a paper cassette 90 is moved along a feeding path 91 between the final transfer roller 70 and the transfer belt 50. The color toner image on the transfer belt 50 is transferred to the paper P due to a final transfer bias applied to the final transfer roller 70. When the paper P passes through the fixing unit 80, the color toner image is fixed to the paper P due to heat and pressure. The paper P with the color toner image fixed thereto is discharged to a discharge tray 93. If double-sided printing is performed, a selector 94 guides the paper P having one surface on which the image is printed after passing through the fixing unit 80 to a double-sided printing path 92. Accordingly, the paper P is supplied again between the transfer belt 50 and the final transfer roller 70, and another image is transferred to the other surface of the paper P. The paper P passing again through the fixing unit 80 is guided to the discharge tray 93 by the selector 94.

Figure 3:
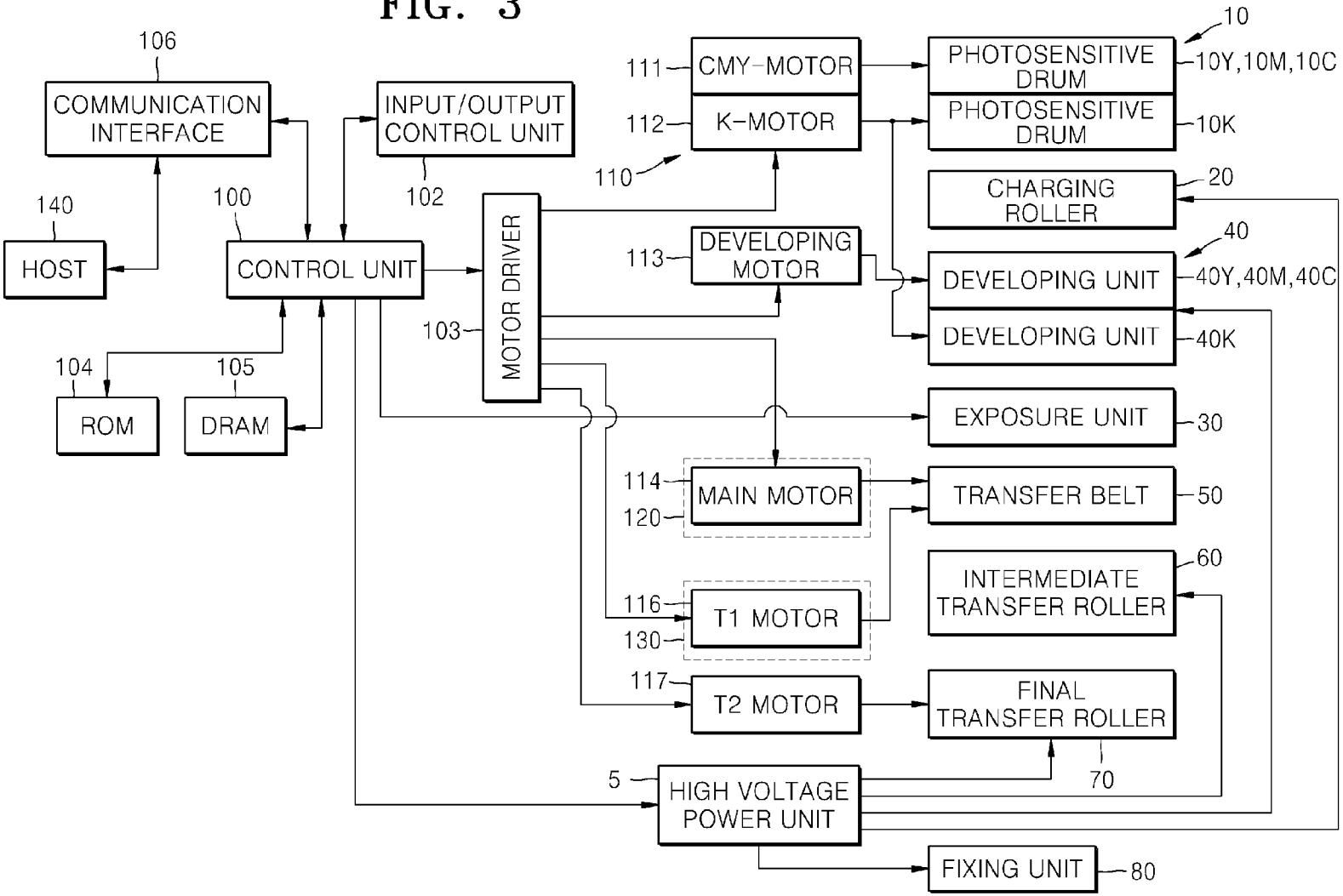
FIG. 3 is a block diagram to explain a control relationship between elements of the image forming apparatus of FIG. 1.

FIG. 3 is a block diagram to explain a control relationship between elements of the image forming apparatus of FIG. 1. Referring to FIG. 3, a first driving unit 110 to drive the photosensitive drums 10Y, 10M, 10C, and 10M may include a CMY-motor 111 and a K-motor 112. The photosensitive drums 10Y, 10M, and 10C are rotated by the CMY-motor 111 and the photosensitive drum 10K is rotated by the K-motor 112 at a rotational speed to correspond to a predetermined process speed. The first driving unit 110 may further include power transmitting elements to transmit power, such as, for example, a gear, a belt, a coupling, and a clutch, which are disposed between the CMY-motor 111 and the K-motor 112 and the photosensitive drums 10Y, 10M, 10C, and 10K.

Elements of the developing units 40Y, 40M, and 40C are driven by a developing motor 113. The developing unit 40K is driven by the K-motor 112. Power transmitting elements to transmit power, such as a gear, a belt, a coupling, and a clutch, may be disposed between the developing motor 113 and the K-motor 112, and the developing units 40Y, 40M, 40C, and 40K. The reason why the photosensitive drum 10K and the developing unit 40K are driven by the K-motor 112 is to drive only the photosensitive drum 10K and the developing unit 40K when a monochrome image, for example, an image using only black and white colors, needs to be printed. Although not shown, the developing unit 40K may be driven by a separate K-developing motor.

A second driving unit 120 to drive the transfer belt 50 may include a main motor 114. The main motor 114 may drive, at the predetermined process speed as described above, the transfer belt 50, the intermediate transfer roller 60, the final transfer roller 70, and rollers to feed the paper P. The second driving unit 120 may further include power transmitting elements to transmit power, such as a gear, a belt, a coupling, and a clutch, which are disposed between the main motor 114, the transfer belt 50, the intermediate transfer roller 60, the final transfer roller 70, and the rollers to feed the paper P. The main motor 114 may rotate support rollers 51 and 52 that support the transfer belt 50.

Figure 4:
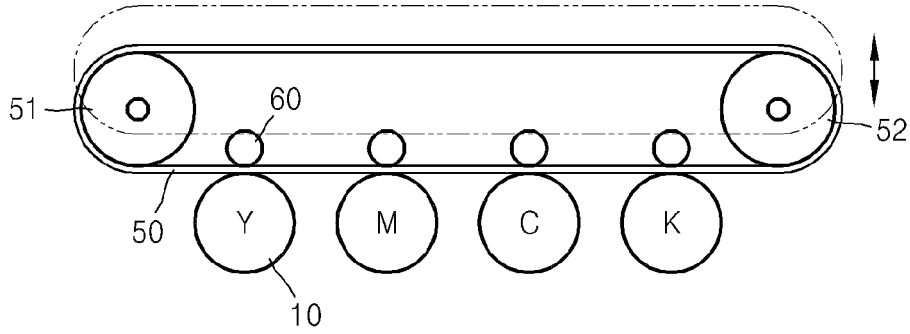
FIG. 4 is a cross-sectional view illustrating a state where a transfer belt is moved to a contact position and a separation position according to an embodiment of the present general inventive concept.
Figure 5:
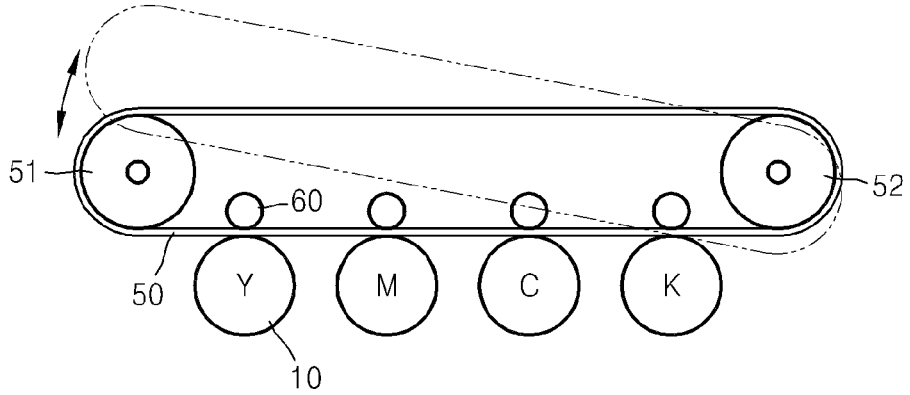
FIG. 5 is a cross-sectional view illustrating a state where the transfer belt is moved to the contact position and the separation position according to another embodiment of the present general inventive concept.

FIG. 4 is a cross-sectional view illustrating a state where the transfer belt 50 is moved to a contact position and a separation position according to an embodiment of the present general inventive concept. FIG. 5 is a cross-sectional view illustrating a state where the transfer belt 50 is moved to the contact position and the separation position, according to another embodiment of the present general inventive concept. As shown by a solid line and a dotted line of FIG. 4, the transfer belt 50 may be moved to a contact position where the transfer belt 50 contacts the photosensitive drums 10Y, 10M, 10C, and 10K, and to a separation position where the transfer belt 50 is spaced apart from the photosensitive drums 10Y, 10M, 10C, and 10K. The transfer belt 50 may be located in the separation position when printing is not performed. In order to perform color printing, the transfer belt 50 moves to the contact position where the transfer belt 50 contacts the photosensitive drums 10Y, 10M, 10C, and 10K. As shown by a dotted line of FIG. 5, the transfer belt 50 may be located in a monochrome image printing position where the transfer belt 50 contacts only the photosensitive drum 10K for the purpose of monochrome image printing.

A belt moving unit 130 (see FIG. 3) to move the transfer belt 50 to the contact position and to the separation position may include a T1-motor 116. The transfer belt 50, the support rollers 51 and 52 to support the transfer belt 50, and the intermediate transfer rollers 60Y, 60M, 60C, and 60K may be installed on a frame (not shown). The transfer belt 50 may be moved to the contact position or to the separation position by lifting the frame (see FIG. 4) or pivoting the frame (see FIG. 5) by using a driving force of the T1-motor 116 as illustrated in FIG. 3.

Figure 6:
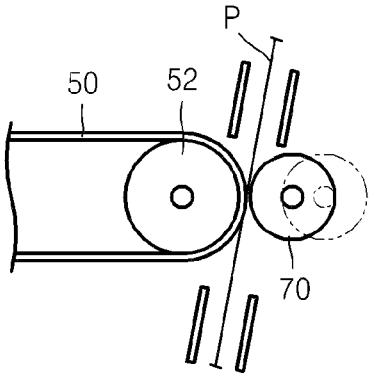
FIG. 6 is a cross-sectional view to explain a positional relationship between a final transfer roller and the transfer belt according to an embodiment of the present general inventive concept.

The final transfer roller 70 may contact the transfer belt 50 when printing is being performed, and may be spaced apart from the transfer belt 50 when printing is not being performed. FIG. 6 is a cross-sectional view illustrating a positional relationship between the final transfer roller 70 and the transfer belt 50. As shown in FIG. 6, a T2-motor 117 (see FIG. 3) moves the final transfer roller 70 to bring the final transfer roller 70 in contact with the transfer belt 50 and to separate the final transfer roller from the transfer belt 50.

A high voltage power unit 5 (see FIG. 3) applies a charge bias, a developing bias, an intermediate transfer bias, and a final transfer bias to the charging roller 20, the developing roller 41, the intermediate transfer roller 60, and the final transfer roller 70, respectively. The high voltage power unit 5 also applies a driving voltage to drive a heat source of the fixing unit 80 to the fixing unit 80.

A control unit 100 may operate based on a program read from a read only memory (ROM) 104. The control unit 100 analyzes image information received from a host 140 based on the program read from the ROM 104 and converts the image information into printing information to be printed. A dynamic random access memory (DRAM) 105 is connected to the control unit 100, and is used as a memory unit to store image data and the operation of the control unit 100. The control unit 100 may be connected to the host 140 via a communication interface 106. User manipulation information may be input to the control unit 100 through an input/output control unit 102, and information to be displayed on a display device (not shown) may also be input to the display device through the input/output control unit 102. The user manipulation information may be input to the control unit 100 via the communication interface 106 by using a user interface (UI) program that is installed in the host 140. In this case, the user manipulation information transmitted from the control unit 100 may be displayed in the UI program that is installed in the host 140.

The control unit 100 may include a motor driver 103 (not illustrated). Alternatively, the control unit 100 and a motor driver 103 may be separate units, as illustrated in FIG. 3. The motor driver 103 receives from the control unit 100 a control signal indicating a drive initiating time, a drive speed, a drive terminating time, and the like for each of the motors to drive the elements of the image forming apparatus, and drives each of the motors based on the control signal. The control unit 100 controls the high voltage power unit 5 to turn on or off the charge bias, the developing bias, the intermediate transfer bias, and the final transfer bias.

A control operation to print an image includes a pre-printing process, a printing process, and a post-printing process. The above processes will be explained below by illustrating an operation to prevent a band image.

When image information is received from the host 140, the control unit 100 generates printing information to print. When the printing information is completely generated, the control unit 100 generates a printing command signal. The elements of the image forming apparatus are controlled to operate based on the printing command signal.

In the case of monochrome image printing, the transfer belt 50 should be located in the monochrome image printing position where the transfer belt 50 contacts the photosensitive drum 10K only, as shown by the dotted line of FIG. 5. In the case of color image printing, the transfer belt 50 should be located in the contact position where the transfer belt 50 contacts all of the photosensitive drums 10Y, 10M, 10C, and 10K, as shown by the solid lines of FIGS. 4 and 5. The control unit 100 determines whether image information input from the host 140 is a color image or a monochrome image, and drives the T1-motor 116 to move the transfer belt 50 to an appropriate position. When the transfer belt 50 is moved from the separation position marked by the dotted line of FIG. 4 to the contact position marked by the solid line after the rotation/moving of the transfer belt 50 and the photosensitive drum(s) 10 are started, a frictional impact may be applied to the photosensitive drum(s) 10 due to the transfer belt 50 at a point of time when the transfer belt 50 contacts the photosensitive drum(s) 10. Also, when the transfer belt 50 is moved from the contact position to the monochrome image printing position for the purpose of monochrome image printing after the rotation/moving of the transfer belt 50 and the photosensitive drum(s) 10 are started in FIG. 5, a frictional impact may be applied to the photosensitive drum 10K due to the transfer belt 50 while the transfer belt 50 is pivoted. Also, the transfer belt 50 may be temporarily moved in a direction in which the transfer belt 50 contacts the photosensitive drum 10 due to an inertial force at a point of time when the transfer belt 50, which is in the contact position or the monochrome image printing position, is pivoted to the separation position, thereby resulting in temporary electrical damage to the photosensitive layer of the photosensitive drum 10. Accordingly, the control unit 100 recognizes the position of the transfer belt 50 by checking a state of a sensor (not shown), and controls the belt moving unit 130 and the first and second driving units 110 and 120 to initiate the rotation/moving of the transfer belt 50 and the photosensitive drum 10 after the transfer belt 50 is moved to the contact position or to the separation position.

The control unit 100 controls the image forming apparatus to perform a pre-printing process. The pre-printing process refers to a process of driving the elements of the image forming apparatus before printing so that the elements of the image forming apparatus can be in states suitable to perform the printing. The driving of the elements in the pre-printing process is based on a previous printing operation. The pre-printing process will be described in further detail below. The control unit 100 generates drive initiating signals to drive, for example, the photosensitive drum(s) 10, the developing unit 40, and the transfer belt 50, and transmits the drive initiating signals to the motor driver 103. The motor driver 103 generates driving signals according to rotational speeds of the motors based on the drive initiating signals, and rotates the motors.

When the CMY-motor 111, the K-motor 112, and the main motor 114 begin to rotate, the photosensitive drums 10(Y,M, C,K) and the transfer belt 50 begin to be rotated/moved. In the case of monochrome image printing, the K-motor 112 and the main motor 114 can rotate. At this time, if the linear speed of the photosensitive drum(s) 10 and the moving speed of the transfer belt 50 are different from each other, the photosensitive drum(s) 10 and the transfer belt 50 create friction therebetween. Static electricity produced due to the friction between the photosensitive drum(s) 10 and the transfer belt 50 causes an electrical impact to a photosensitive layer of the photosensitive drum(s) 10, and thus a part of the photosensitive layer of the photosensitive drum(s) may be undesirably affected, and thus temporarily lose their functional capabilities.

Electrophotographic printing involves charging a surface of the photosensitive drum(s) 10 to a predetermined potential, emitting light, which has been modulated to correspond to image information, attaching toner by using a potential difference between a portion to which the light is emitted and a portion to which the light is not emitted, and printing an image. A potential at the undesirably affected part of the photosensitive layer is changed, thereby leading to a problem such as causing a band image, which is a printed image on which dark or light stripes appear in a direction perpendicular to a longitudinal direction of the photosensitive drum 10, that is, a feeding direction of the paper P. The band image may be seen during an initial stage of printing, but may disappear as the printing proceeds, and the photosensitive drum 10 may recover from the undesirable affect. Since the linear speed of the photosensitive drum(s) 10 and the moving speed of the transfer belt 50 during printing are controlled by the control unit 100 to maintain the predetermined process speed, friction due to a speed difference between the photosensitive drum(s) 10 and the transfer belt 50 rarely occurs during the printing. However, when driving is initiated in a state where the photosensitive drum(s) 10 and the transfer belt 50 are stopped, there may be a difference between the moving speed and the linear speed. That is, when the photosensitive drum(s) 10 and the transfer belt 50 fail to simultaneously begin to be driven and any one of the photosensitive drum(s) 10 and the transfer belt 50 is delayed, the photosensitive drum(s) 10 and the transfer belt 50 may create a friction therebetween. To simultaneously begin driving the photosensitive drum(s) 10 and the transfer belt 50 which are in a stopped position, the control unit 100 of the image forming apparatus of FIG. 1 controls the first driving unit 110 and the second driving unit 120 to initiate driving of the photosensitive drum(s) 10 and the transfer belt 50, respectively, with a time interval.

One factor causing a speed difference between the photosensitive drum(s) 10 and the transfer belt 50 at drive initiating times is a difference between flexibility of the photosensitive drums 10 and flexibility of the transfer belt 50. Generally, the photosensitive drums 10 have little flexibility whereas the transfer belt 50 is formed of a soft material and has a higher flexibility. Accordingly, even when the CMY-motor 111 and the K-motor 112, and the main motor 114 begin to simultaneously rotate, the transfer belt 50 begins to be driven after some delay due to its relatively high flexibility. Accordingly, the control unit 100 may transmit a second drive initiating signal to the motor driver 103 for the second driving unit 120 to initiate the driving of the transfer belt 50, and then a first drive initiating signal to the motor driver 103 for the first driving unit 110 to initiate the driving of the photosensitive drum(s) 10.

Another factor causing a speed difference between the photosensitive drum(s) 10 and the transfer belt 50 at drive initiating times is a difference between an amount of backlash of the power transmitting elements disposed between the CMY-motor 111 and the K-motor 112, and the photosensitive drum(s) 10, and the amount of backlash of the power transmitting elements between the main motor 114 and the transfer belt 50. A time interval between the second drive initiating signal and the first drive initiating signal may vary according to conditions, such as, for example, a type, number, and arrangement of the power transmitting elements, a material of the transfer belt 50, and response speeds of the motors. The time interval may be determined by experimentation. Information regarding the time interval determined by the experimentation may be stored in, for example, the ROM 104, and the control unit 100 may sequentially generate the second driving signal and the first driving signal based on the information regarding the time interval read from the ROM 104. If the first driving unit 110 and the second driving unit 120 include a coupling or a clutch to control power, the control unit 100 may simultaneously generate the first and second driving signals, and control the first and second driving units 110 and 120 with the time interval to switch the coupling or the clutch to a power ON state.

The control unit 100 may control the first and second driving units 110 and 120 so that the photosensitive drum 10 and the transfer belt 50 reach a speed to correspond to a process speed by being accelerated through a plurality of acceleration stages from the state where the photosensitive drum 10 and the transfer belt 50 are stopped. Accordingly, friction between the photosensitive drum 10 and the transfer belt 50 which may be caused due to a speed difference between the photosensitive drum 10 and the transfer belt 50 at drive initiating times may be reduced by sequentially accelerating from a lower speed.

During a pre-printing process, the control unit 100 may perform a pre-rotation operation of controlling the high voltage power unit 5 to apply a charge bias to the charging rollers 20 in a state where the photosensitive drums 10Y, 10M, 10C and 10K are rotated. The photosensitive layer of the photosensitive drums 10Y, 10M, 10C and 10K may recover from the temporary damage (i.e., an undesired affect on the surface) due to the friction between the transfer belt 50 and the photosensitive drums 10Y, 10M, 10C and 10K by rotating the photosensitive drums 10Y, 10M, 10C and 10K and supplying charges to the surface of the photosensitive drums 10Y, 10M, 10C and 10K from the respective charging roller 20 during the pre-printing process.

In the pre-printing process, the control unit 100 may divide the printing into a "continuous printing" and an "intermittent printing" according to a waiting time after a previous printing operation is performed. The control unit 100 may set different pre-rotation times to the continuous printing and the intermittent printing processes. The pre-rotation times, for example, refer to a rotation time for which the photosensitive drum 10 is rotated in a state where a charge bias is applied during the pre-printing process. An intermediate transfer bias applied during the previous printing operation may affect the photosensitive layer of the photosensitive drum 10. The photosensitive layer may be capable of recovering from such an affect as the waiting time elapses. However, since the waiting time is short in the continuous printing process, the photosensitive layer of the photosensitive drums which are affected by the intermediate transfer bias applied during the previous printing operation may insufficiently recover or may not be recovered at all.

A criteria by which the continuous printing or the intermittent printing is determined may vary according to the image forming apparatus. For example, according to an exemplary embodiment, if the waiting time is greater than 20 minutes, a printing process may be determined to be the intermittent printing process, and if the waiting time is less than 20 minutes, the printing process may be determined to be the continuous printing process. The control unit 100 may determine whether the printing process is the intermittent printing process or the continuous printing process by checking the waiting time, and may increase a pre-rotation time during the continuous printing to be longer than a pre-rotation time during the intermittent printing.

Figure 7:
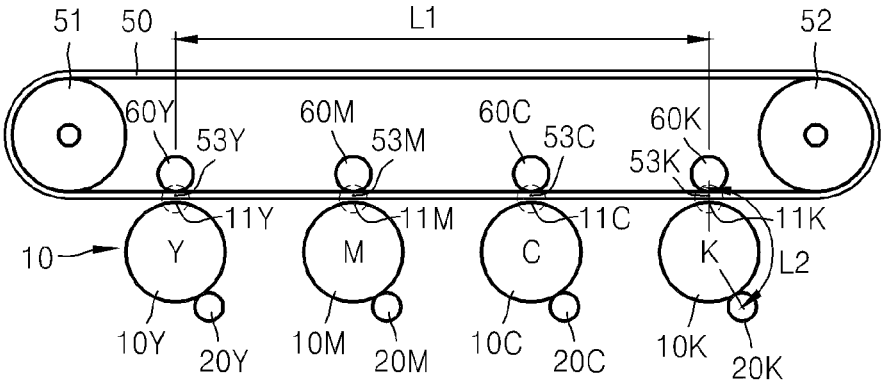
FIGS. 7-9 are cross-sectional views to explain a method of determining an amount of rotation/moving of a photosensitive drum and the transfer belt necessary to prevent a band image after an intermediate transfer bias is turned off according to an embodiment of the present general inventive concept.
Figure 8:
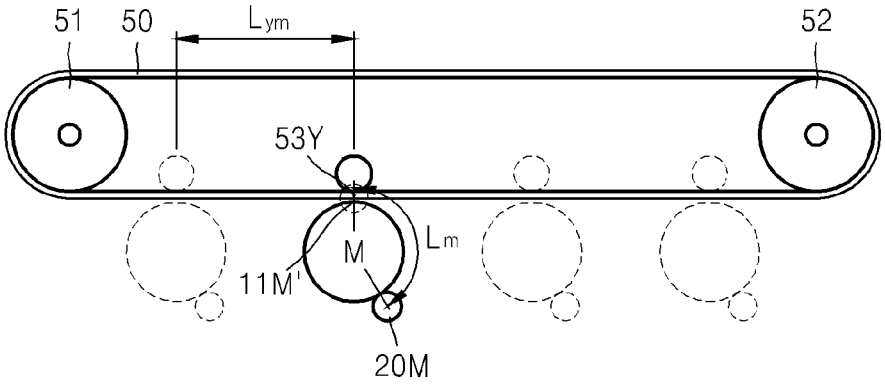
Figure 9:
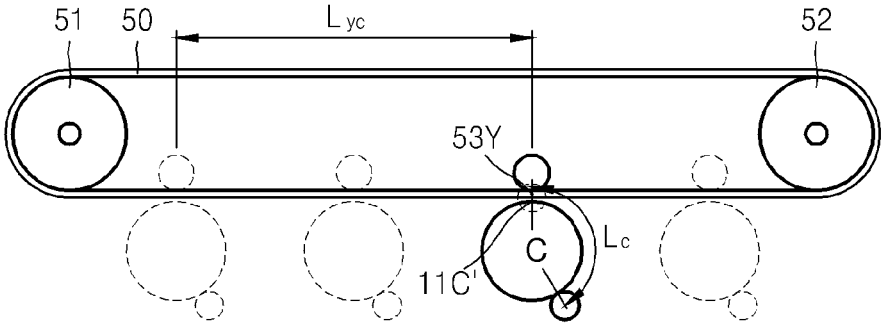

FIGS. 7 through 9 are cross-sectional views illustrating a method of determining the amount of rotation/moving of the photosensitive drums 10Y, 10M, 10C and 10K and the transfer belt 50 necessary to prevent a band image after an intermediate transfer bias is turned off. Referring to FIG. 7, an intermediate transfer bias that can be applied to the intermediate transfer rollers 60Y, 60M, 60C, and 60K at the time of previous printing is turned off when the previous printing is completed. Areas 53Y, 53M, 53C, and 53K of the transfer belt 50 facing the intermediate transfer rollers 60Y, 60M, 60C, and 60K, respectively, at a point of time when the intermediate bias is turned off are charged to a predetermined potential due to the intermediate transfer bias. Here, the predetermined potential affects the photosensitive layers of the photosensitive drums 10Y, 10M, 10C, and 10K. That is, areas 11Y, 11M, 11C, and 11K of the photosensitive drums 10Y, 10M, 10C, and 10K facing the areas 53Y, 53M, 53C, and 53K of the transfer belt 50 at the point of time when the intermediate transfer bias is turned off may be temporarily electrically damaged (i.e., an undesired affect on the surface) due to the intermediate transfer bias. When the transfer belt 50 and the photosensitive drums 10Y, 10M, 10C, and 10K are moved/rotated and the areas 11Y, 11M, 11C, and 11K of the respective photosensitive drums pass through positions facing/contacting the charging rollers 20Y, 20M, 20C, and 20K, the potential of the areas 11Y, 11M, 11C, and 11K of the respective photosensitive drums may be reset and the areas 11Y, 11M, 11C, and 11K may recover from the temporary damage (undesired affect). The area 11Y of the photosensitive drum 10Y, which is referred to as an uppermost photosensitive drum in a moving direction of the transfer belt 50, is removed from the area 53Y as soon as the transfer belt 50 begins to move. When the area 11Y passes by the position of the charging roller 20Y as the photosensitive drum 10Y is rotated, the potential of the area 11Y may be reset due to the charge bias from the charging roller 20Y and the area 11Y of the photosensitive drum 10Y may recover from the undesirable affect on its surface. The area 11M of the photosensitive drum 10M is rapidly removed from the area 53M of the transfer belt 50 as the transfer belt 50 is moved. However, the area 53Y of the transfer belt 50 affects the photosensitive layer of the photosensitive drum 10M again. As shown in FIG. 8, when an area 11M' affected by the area 53Y of the transfer belt 50 passes by the position of the charging roller 20M, the potential of the area 11M' may be reset due to the charge bias from the charging roller 20M and the photosensitive layer of the photosensitive drum 10M may recover from the undesirable affect on its surface. Accordingly, when a distance between the photosensitive drum 10Y and the photosensitive drum 10M is Lym and a circumferential distance between a contact point between the photosensitive drum 10M and the transfer belt 50 and the charging roller 20M is Lm, the photosensitive drum 10M can be free from the influence of the intermediate transfer bias after a time taken for the photosensitive drum 10M to be rotated by at least a circumferential distance corresponding to Lym+Lm elapses. The photosensitive drum 10C is sequentially affected by the areas 53C, 53M, and 53Y. As shown in FIG. 9, only when an area 11C' affected by the area 53Y passes through the position of the charging roller 20C, the potential of the area 11C' may be reset due to the charge bias and the photosensitive layer of the photosensitive drum 10C may recover from the undesirable affect on its surface, and thus can be free from the influence of the intermediate transfer bias. In this regard, when a distance between the photosensitive drum 10Y and the photosensitive drum 10C is Lyc and a circumferential distance between a contact point between the photosensitive drum 10C and the transfer belt 50 and the charging roller 20C is Lc, the photosensitive drum 10C can be free from the influence of the intermediate transfer bias after a time taken for the photosensitive drum 10C to be rotated by at least a circumferential distance corresponding to Lyc+Lc elapses. After a portion of the photosensitive drum 10K, which is referred to as a lowermost photosensitive drum affected by the area 53Y, passes by a position facing/contacting the charging roller 20K, the photosensitive drum 10K can be free from the influence of the intermediate transfer bias. Hence, when a distance between the photosensitive drum 10Y, which is the uppermost photosensitive drum, and the photosensitive drum 10K, which is the lowermost photosensitive drum, is L1 (see FIG. 7) and a circumferential distance between a contact point between the photosensitive drum 10K and the transfer belt 50 and a contact point between the photosensitive drum 10K and the charging roller 20K is L2, the pre-rotation time used to rotate the photosensitive drum 10K during the continuous printing in a pre-printing process may be determined to be greater than a time taken for the photosensitive drum 10K to be rotated by a distance corresponding to L1+L2. The pre-rotation time for intermittent printing and the pre-rotation time for the continuous printing may be previously set and stored in the ROM 104. The pre-rotation time for the continuous printing may vary according to the waiting time.

The control unit 100 may include an additional pre-rotation time in addition to the pre-rotation times for the intermittent printing and the continuous printing. The control unit 100 may use a first additional pre-rotation time according to the type of printed image. For example, in the case of an image having a high coverage, even a light band image may be easily seen with the eyes. Here, the term coverage refers to a ratio between an area in which an image exists and a total printed area. Also, in the case of an image having a high density, a band image may also be easily seen with the eyes. If an image having a high coverage and a high density is being printed, a sufficient time needs to be given to recover from temporary damage to the photosensitive drum 10 by applying a charge bias during a pre-printing process to the photosensitive drum(s) 10 for an increased period of time in which the photosensitive drum 10 is rotated. Accordingly, the control unit 100 uses an additional pre-rotation time when an image having a high coverage and a high density is printed. A first additional previous rotation time may be previously set and stored in, for example, the ROM 104. According to experiments, when a coverage is greater than 30% and an image density is greater than 30%, a band image visible to the eyes is usually produced. Accordingly, the control unit 100 may use the first additional pre-rotation time when the coverage is greater than 30% and the image density is greater than 30%.

A second additional pre-rotation time may be used according to a process speed. The image forming apparatus may have a plurality of process speeds. A low process speed slower than a reference process speed is used when an image having high resolution and high image quality is printed, and a high process speed faster than the reference process speed is used when an image having low image quality and low resolution is printed. Generally, when a low process speed is used, a band image is more often produced. That is because, when a low process speed is used, since rotation/moving speeds of the photosensitive drum 10 and the transfer belt 50 are low, contact and friction is longer when the photosensitive drums 10Y-10K and the transfer belt 50, which are stopped, begin to be rotated/moved. Accordingly, in order to sufficiently recover from a temporary damage to the photosensitive drums 10 using the charge bias during the pre-printing process, the control unit 100 may use the second additional pre-rotation time when the low process speed slower than the reference process speed is used.

As the number of rotations of the photosensitive drums 10 increases, the lifetime of the photosensitive drums 10 decreases. As described above, the decrease in the lifetime of the photosensitive drums 10 may be reduced by varying pre-rotation times according to the type of image being printed.

When the pre-printing process is completed, a printing process is performed. The control unit 100 controls the elements of the image forming apparatus to print an image on the paper P by performing charging, exposing, developing, intermediate transferring, final transferring, and fixing. The paper P on which the image is completely printed is discharged to the discharge tray 93.

When the printing process is completed, a post-printing process is performed. The post-printing process is a process of stopping operations of the elements of the image forming apparatus after the printing is completed. Here, the post-printing process is a process of stopping the rotation/moving of the photosensitive drums 10 and the transfer belt 50 to prevent a band image.

Referring to FIG. 7 again, the control unit 100 controls the high voltage power unit 5 to turn off an intermediate transfer bias applied to the intermediate transfer rollers 60Y, 60M, 60C, and 60K when the printing process is completed. As described above, the areas 53Y, 53M, 53C, and 53K of the respective photosensitive drums 10 facing the intermediate transfer rollers 60Y, 60M, 60C, and 60K at a point of time when the intermediate transfer bias is turned off are charged to a predetermined potential due to the intermediate transfer bias, and the potential may temporarily damage the photosensitive layers of the photosensitive drums 10Y, 10M, 10C, and 10K. If a subsequent printing operation is performed after the photosensitive drums 10 and the transfer belt 50 are stopped while the temporary damage to the photosensitive layers of the photosensitive drums is maintained, a band image may be produced on a subsequent printed image. Accordingly, in order to recover from the damage to the photosensitive layer of the photosensitive drums 10 due to the intermediate transfer bias, embodiments of the present general inventive concept perform a pre-printing process in which a charge bias is applied to the photosensitive drums 10. As described above, the area 11Y of the photosensitive drum 10Y, which is the uppermost photosensitive drum, is removed from the influence of the area 53Y, which is charged, of the transfer belt 50 as soon as the transfer belt 50 begins to move. However, the photosensitive drum 10M may be affected again by the area 53Y, the photosensitive drum 10C may be affected again by the areas 53Y and 53M, and the photosensitive drum 10K may be affected again by the areas 53Y, 53M, and 53C as the transfer belt 50 continues to move. In other words, as the transfer belt 50 is moved/rotated, the photosensitive drum 10K is eventually removed from the areas 53K, 53C, 53M, and 53Y of the transfer belt 50. Thus, as the photosensitive drum 10K continuously rotates, it is not until after a portion of the photosensitive drum 10K affected by the area 53Y of the transfer belt 50 passes through a position facing/contacting the charging roller 20K, that the photosensitive drum 10K can be completely free from the influence of an intermediate transfer bias, and the temporary damage to the photosensitive drum 10K is repaired. Accordingly, the control unit 100 controls the first and second driving units 110 and 120 to stop the photosensitive drums 10 and the transfer belt 50, respectively, after the photosensitive drum 10K, which is the lowermost photosensitive drum, is completely free from the influence of the intermediate transfer bias. The photosensitive drum 10K is free from the influence of the intermediate transfer bias when the photosensitive drum 10K rotates by at least a distance corresponding to L1+L2 of FIG. 7, after the control unit 100 controls the high voltage power unit 5 to turn off the intermediate transfer bias. The control unit 100 also controls the high voltage power unit 5 to turn off the charge bias after the photosensitive drums 10 and the transfer belt 50 are stopped.

Accordingly, a band image can be prevented and a decrease in the lifetime of the photosensitive drums 10 can be reduced by optimizing the amount of rotation of the photosensitive drums 10 after printing is completed.

When the transfer belt 50 needs to be moved to the separation position of FIG. 4 or 5, the control unit 100 controls the first and second driving units 110 and 120 and the belt moving unit 130 to move the transfer belt 50 after the photosensitive drums 10Y, 10M, 10C and 10K and the transfer belt 50 are stopped.

Although a few embodiments of the present invention have been shown and described, it would be appreciated by those skilled in the art that changes may be made in these embodiments without departing from the principles and spirit of the general inventive concept, the scope of which is defined in the claims and their equivalents.

What is claimed is:

1. A printing method usable with an image forming apparatus, the method comprising:

initiating driving of a plurality of photosensitive bodies and a transfer belt;

printing an image by forming toner images on the plurality of photosensitive bodies, which are charged by a plurality of charging units, applying an intermediate transfer bias to a plurality of intermediate transfer units, which face the plurality of photosensitive bodies with the transfer belt therebetween, to transfer the toner images to the transfer belt, and finally transferring the toner images, which are transferred to the transfer belt, to paper; and stopping the driving of the plurality of photosensitive bodies and the transfer belt after the printing of the image is completed, wherein the initiating of the driving of the plurality of photosensitive bodies and the transfer belt comprises applying drive initiating signals with a time interval to a first driving unit to drive the plurality of photosensitive bodies and a second driving unit to drive the transfer belt to enable the plurality of photosensitive bodies and the transfer belt to begin simultaneously rotating/moving.

2. The printing method of claim 1, wherein a second drive initiating signal is first applied to the second driving unit, and then after the time interval elapses, a first drive initiating signal is applied to the first driving unit.

3. The printing method of claim 2, wherein the plurality of photosensitive bodies and the transfer belt reach a speed corresponding to a predetermined process speed through a plurality of acceleration stages.

4. The printing method of claim 1, wherein the initiating of the driving of the plurality of photosensitive bodies and the transfer belt comprises, before applying the drive initiating signals, moving the transfer belt to a contact position where the transfer belt contacts the plurality of photosensitive bodies and to a separation position where the transfer belt is spaced apart from at least one of the plurality of photosensitive bodies.

5. The method of claim 1, wherein the initiating of the driving of the plurality of photosensitive bodies and the transfer belt comprises, before initiating printing, previously rotating/moving the plurality of photosensitive bodies and the transfer belt during a previous rotation time in a state where a charge bias is applied to the plurality of charging units to charge the plurality of photosensitive bodies, wherein, when the printing is divided into intermittent printing and continuous printing based on a waiting time after previous printing, and the previous rotation time during the intermittent printing is referred to as a first previous rotation time and the previous rotation time during the continuous printing is referred to as a second previous rotation time, the previously rotating/moving of the plurality of photosensitive bodies and the transfer belt comprises making the second previous rotation time longer than the first previous rotation time.

6. The printing method of claim 5, wherein, if the waiting time is less than 20 minutes, the printing is determined to be the continuous printing, and if the waiting time is greater than 20 minutes, the printing is determined to be the intermittent printing.

7. The printing method of claim 5, wherein, when a distance between an uppermost photosensitive body of the plurality of photosensitive bodies and a lowermost sensitive body of the plurality of photosensitive bodies in a moving direction of the transfer belt is L1, and a circumferential distance between a contact point between the lowermost photosensitive body and the transfer belt and a charging unit corresponding to the lowermost photosensitive body is L2, the second previous rotation time is greater than a time taken for the lowermost photosensitive body to be rotated by a distance corresponding to L1+L2.

8. The printing method of claim 5, wherein the previously rotating/moving of the plurality of photosensitive bodies and the transfer belt comprises adding a first additional previous rotation time to the previous rotation time when an image having high coverage and high density needs to be printed.

9. The printing method of claim 8, wherein, when an image having a coverage of greater than 30% and a density of greater than 30% needs to be printed, the first additional previous rotation time is used.

10. The printing method of claim 5, wherein the previously rotating/moving of the plurality of photosensitive bodies and the transfer belt comprises using a second additional previous rotation time when a process speed is less than a reference process speed.

11. The printing method of claim 1, wherein, when a distance between a lowermost photosensitive body of the plurality of photosensitive bodies and an uppermost photosensitive body of the plurality of photosensitive bodies in a moving direction of the transfer belt is L1 and a circumferential distance between a contact point between the lowermost photosensitive body and the transfer belt and a charging unit corresponding to the lowermost photosensitive body is L2, the stopping of the driving of the plurality of photosensitive bodies and the transfer belt comprises:

stopping the plurality of photosensitive bodies and the transfer belt after the lowermost photosensitive body is rotated by at least a distance corresponding to L1+L2 after the intermediate transfer bias is turned off, and turning off a charge bias applied to the plurality of charging units after the plurality of photosensitive bodies are stopped.

12. An image forming apparatus comprising:

a plurality of photosensitive bodies;

a plurality of charging units to which a charge bias to charge the plurality of photosensitive bodies to a uniform potential is applied;

an exposure unit which forms electrostatic latent images to correspond to image information on the plurality of photosensitive bodies that are charged to the uniform potential;

a plurality of developing units which supply toner to the electrostatic latent images to form visible toner images;

a transfer belt which faces the plurality of photosensitive bodies and allows the toner images to be transferred to the transfer belt;

a plurality of intermediate transfer units to which an intermediate transfer bias to transfer the toner images to the transfer belt is applied;

a first driving unit and a second driving unit which drive the plurality of photosensitive bodies and the transfer belt, respectively; and a control unit which applies drive initiating signals with a time interval to the first driving unit and the second driving unit so that the plurality of photosensitive bodies and the transfer belt begin simultaneously rotating/moving.

13. The image forming apparatus of claim 12, wherein the control unit first applies a second drive initiating signal to the second driving unit, and then, after the time interval is elapsed, applies a first drive initiating signal to the first driving unit.

14. The image forming apparatus of claim 13, wherein the control unit controls the first driving unit and the second driving unit so that the plurality of photosensitive bodies and the transfer belt reach a speed corresponding to a predetermined process speed through a plurality of acceleration stages.

15. The image forming apparatus of claim 12, further comprising a belt moving unit which moves the transfer belt to a contact position where the transfer belt contacts the plurality of photosensitive bodies and to a separation position where the transfer belt is spaced apart from at least one of the plurality of photosensitive bodies, wherein the control unit controls the first driving unit, the second driving unit, and the belt moving unit to move the transfer belt to the contact position and to the separation position in a state where the plurality of photosensitive bodies and the transfer belt are stopped.

16. The image forming apparatus of claim 12, wherein, when a distance between an uppermost photosensitive body of the plurality of photosensitive bodies and a lowermost photosensitive body of the plurality of photosensitive bodies in a moving direction of the transfer belt is L1 and a circumferential distance between a contact point between the lowermost photosensitive body and the transfer belt and a charging unit corresponding to the lowermost photosensitive body is L2, the control unit controls the first driving unit and the second driving unit to stop the plurality of photosensitive bodies and the transfer belt after the lowermost photosensitive body is rotated by a distance corresponding to L1+L2 after the intermediate transfer bias is turned off, and turns off the charge bias applied to the plurality of charging units after the plurality of photosensitive bodies are stopped.

17. A printing method of preventing a band image on a paper due to an intermediate transfer bias applied in an image forming apparatus, the method comprising:

printing an image in a first printing operation by forming toner images on a plurality of photosensitive bodies, applying an intermediate transfer bias to a plurality of intermediate transfer units that face the plurality of photosensitive bodies to transfer the toner images to a transfer belt, and transferring the toner images from the transfer belt to the paper;

stopping the plurality of photosensitive bodies and the transfer belt from moving after the image is printed; and printing an image in a second printing operation by rotating the photosensitive bodies according to a predetermined rotation and then forming toner images on the plurality of photosensitive bodies, applying an intermediate transfer bias to the plurality of intermediate transfer units to transfer the toner images to the transfer belt, and transferring the toner images from the transfer belt to the paper, wherein the second printing operation is divided into a continuous printing and an intermittent printing which are determined based a waiting time after the first printing operation, and wherein further comprising:

setting a first rotation time to rotate the photosensitive bodies during the intermittent printing; and setting a second rotation time to rotate the photosensitive bodies during the continuous printing.

18. The printing method of claim 17, wherein the first printing operation includes pre-printing, printing, and post-printing.

19. The printing method of claim 17, wherein the second printing operation is determined to be the continuous printing if the waiting time is less than 20 minutes, or the intermittent printing if the waiting time is greater than 20 minutes.

20. The printing method of claim 17, wherein, when a distance between an uppermost photosensitive body of the plurality of photosensitive bodies and a lowermost sensitive body of the plurality of photosensitive bodies in a moving direction of the transfer belt is L1, and a circumferential distance between a contact point between the lowermost photosensitive body and the transfer belt and a charging unit corresponding to the lowermost photosensitive body is L2, the second rotation time used to rotate the photosensitive bodies is greater than a time taken for the lowermost photosensitive body to be rotated by a distance corresponding to L1+L2.

21. A printing method of preventing a band image on a paper due to an intermediate transfer bias applied in an image forming apparatus wherein a printing operation includes forming toner images on a plurality of photosensitive bodies, applying an intermediate transfer bias to a plurality of intermediate transfer units to transfer the toner images to a transfer belt, and transferring the toner images from the transfer belt to the paper, the method comprising:

rotating the photosensitive bodies and the transfer belt a predetermined distance after the intermediate transfer bias is turned off from a previous printing operation;

stopping the photosensitive bodies and the transfer belt from moving after the photosensitive bodies rotate the predetermined distance; and printing a subsequent image, wherein the predetermined distance to rotate the photosensitive bodies correspond to a distance of L1+L2, where:

L1 is a distance between an uppermost photosensitive body of the plurality of photosensitive bodies and a lowermost sensitive body of the plurality of photosensitive bodies in a moving direction of the transfer belt, and L2 is a circumferential distance between a contact point between the lowermost photosensitive body and the transfer belt and a charging unit corresponding to the lowermost photosensitive body.

* * * * *